United States Patent [19]

Edens

[11] Patent Number: 4,571,854

[45] Date of Patent: Feb. 25, 1986

[54] KNOT LATCH DEVICE

[75] Inventor: Robert B. Edens, Houston, Tex.

[73] Assignee: Her Investments, Houston, Tex.

[21] Appl. No.: 487,844

[22] Filed: Apr. 22, 1983

[51] Int. Cl.[4] ..... A43B 11/00; F16G 11/00

[52] U.S. Cl. ..... 36/50; D2/114; 24/119; 24/128

[58] Field of Search ..... 36/50, 51, 54; 24/68 SK, 119, 120, 117, 118, 121, 128, 204, 140; D2/114

[56] References Cited

U.S. PATENT DOCUMENTS

| | | | |
|---|---|---|---|
| D. 270,779 | 10/1983 | Steinberg | D2/314 |
| 760,472 | 5/1904 | McGuinness | 24/119 |
| 982,746 | 1/1911 | Rosencranz | 24/117 |
| 1,703,689 | 2/1929 | Okrainetz et al. | 24/117 R |
| 2,175,962 | 10/1939 | Kenifick | 24/128 |
| 3,473,198 | 10/1969 | Meier | 24/119 |
| 4,114,297 | 9/1978 | Famolare, Jr. | 36/50 |
| 4,291,439 | 9/1981 | Riti | 24/119 |
| 4,308,672 | 1/1982 | Antonious | 36/50 |
| 4,403,375 | 9/1983 | Blum | 24/119 |
| 4,428,101 | 1/1984 | Harkavy | 24/140 |

FOREIGN PATENT DOCUMENTS

| | | | |
|---|---|---|---|
| 4271 | of 1907 | United Kingdom | 36/50 |

*Primary Examiner*—Werner H. Schroeder
*Assistant Examiner*—Steven N. Meyers
*Attorney, Agent, or Firm*—Arnold, White & Durkee

[57] ABSTRACT

A knot latch device for footwear is disclosed having structure readily adapted to receive a shoelace. The shoelace is then bowed about a portion of the knot latch device, and the knot latch device then folded about the bowed lace. The knot latch device includes a plurality of mating hook and loop elements to fasten the device securely about the bowed lace. Structure is included to mask at least a portion of the knot latch device when the device is secured about a bowed lace of the footwear.

3 Claims, 6 Drawing Figures

Fig. 1
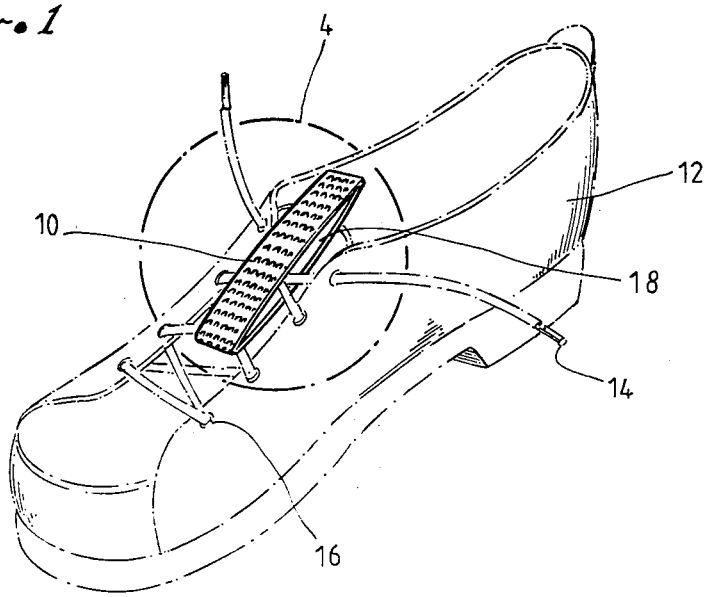
Fig. 2
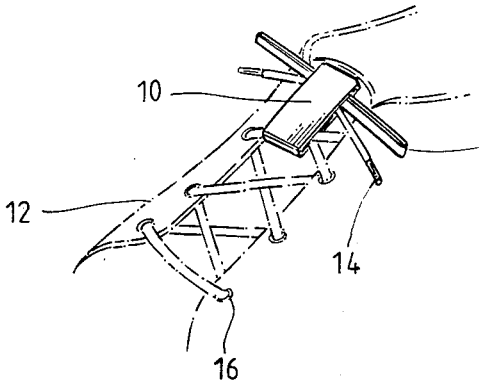
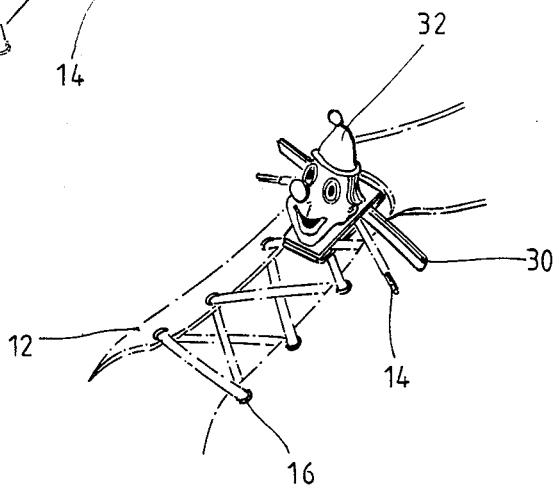
Fig. 3

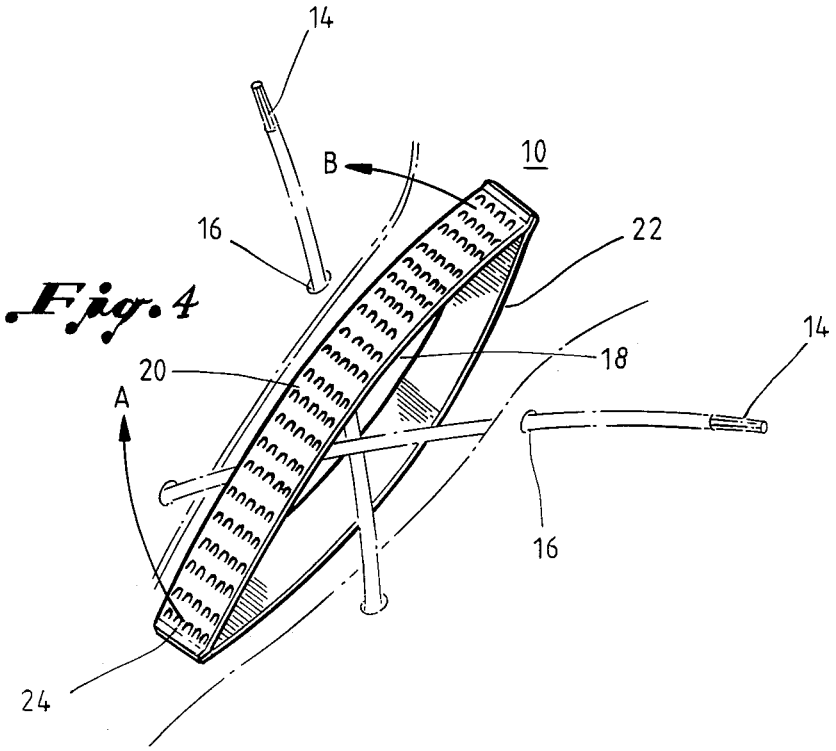
Fig. 4
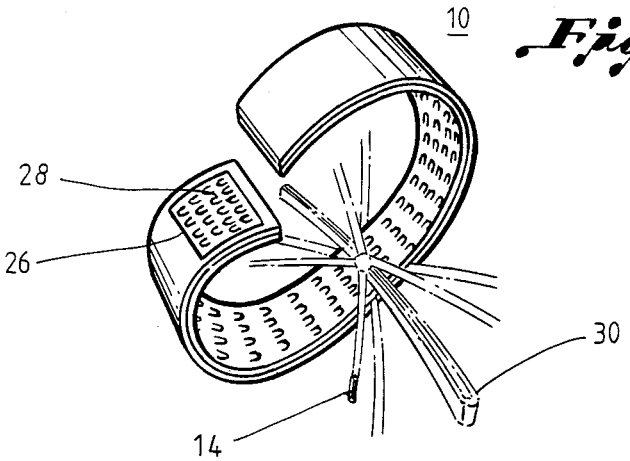
Fig. 5
Fig. 6
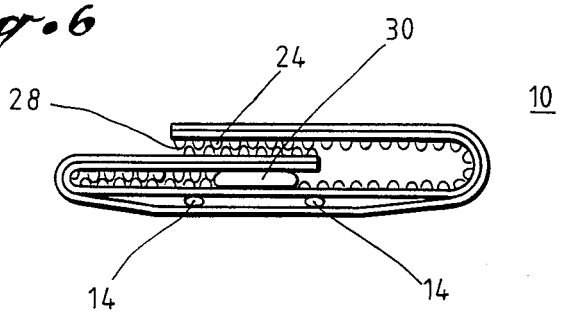

KNOT LATCH DEVICE

BACKGROUND OF THE INVENTION

This invention relates generally to securing devices, and more particularly to a device to secure shoelaces on footwear.

Shoes, sneakers and other footwear which utilize a lace to securely fasten the footwear on the foot of the wearer are well known. While the use of a shoelace facilitates putting a piece of footwear on and taking it off, the shoelace has the inherent problem of loosening or otherwise unfastening. This is particularly true of shoelaces having circular or oval cross-sections. The unfastening, which occurs through normal use of the footwear, creates a safety hazard because the wearer might trip by unknowingly stepping on the unfastened lace. The safety hazard is particular acute for young children, the elderly, and athletes.

One known, age old manner of dealing with this inherent problem is to tie the lace in one or more knots after the lace has been fashioned into a bow. The more securely the lace is knotted, however, the more difficult it is to untie when the wearer desires to remove the piece of footwear. Moreover, little children often lack the strength to securely fasten the lace into a knot.

Prior art devices have been devised in an attempt to prevent the bowed shoelace from untying. Once type of known prior art device includes special structure built into the piece of footwear itself. For example, an elastic band has been fixedly attached to the piece of footwear such that the elastic can be drawn over the bowed lace.

Other known prior art devices include structure having eyelets by which the device is laced onto the shoe. One such known device includes a hinged box in which the bowed shoelace is enclosed. Another such known device includes hook and loop elements disposed on a single face of a flexible strap designed to fold over the bowed lace.

The known prior art devices cannot readily be used, or readily transferred from one piece of footwear to another, by persons having low dexterity and coordination skills. Such persons include young children, and elderly persons suffering from joint diseases such as arthritis—the very people who have the greatest risk of injury occasioned by untied shoelaces.

Thus, there is a need for a knot latched device which can be readily used, even by persons having low dexterity and coordination skills.

SUMMARY OF THE INVENTION

According to the present invention, a knot latch device is provided which can easily be secured to a piece of footwear and easily used by the wearer.

According to one embodiment of the present invention, the knot latch device includes a flexible member having upper and lower faces. Structure is included on one of the faces to define a lace receiving region through which the shoelace passes. The lace is then bowed about the knot latch device.

The flexible member includes releasable locking structure, for example, mating hook and loop elements such as that sold under the trade style VELCRO. The hook elements are included on one of the faces of the flexible member at one of its ends, and the loop elements are included on the other face of the flexible member at its other end. The flexible member is then folded about the bowed shoelace, causing the hook and loop elements to mate.

According to another embodiment of the present invention, a knot latch device includes flexible upper and lower members joined to each other at their ends. The shoelace passes through an opening defined by inner faces of the upper and lower members, and then the ends of the lace are bowed about the knot latch device. Releasable locking structure is included on outer faces of the upper and lower members.

According to another aspect of the present invention an ornamental device or other suitable structure may be included on the knot latch device to mask at least a portion of the flexible member when the device is secured about a bowed shoelace.

BRIEF DESCRIPTION OF THE DRAWINGS

The invention will further be described by reference to the accompanying drawings which illustrate particular embodiments of a knot latch device in accordance with the present invention, wherein like members bear like reference numerals and wherein:

FIG. 1 is a perspective view of a knot latch device in accordance with the present invention, shown in place on a piece of footwear;

FIG. 2 is a perspective view of the knot latch device illustrated in FIG. 1, shown secured about a bowed lace;

FIG. 3 is a perspective view of a knot latch device according to the present invention having masking structure;

FIG. 4 is an enlarged perspective view of a portion of FIG. 1;

FIG. 5 is a perspective view of the knot latch of FIG. 4 as it is moved to its secured position; and FIG. 6 is a planar end view of the knot latch device of FIG. 5 secured about the bowed shoelace.

DESCRIPTION OF THE PREFERRED EMBODIMENTS

Referring now to the drawings, and in particular to FIG. 1, there is shown in perspective view a knot latch device 10 positioned on a shoe 12. A shoelace 14 is threaded through a plurality of eyelets 16 included on the shoe 12. The shoelace 14 passes through a lace receiving region 18 of the knot latch device 10, as is illustrated in more detail in FIG. 4.

Referring now to FIG. 4, the knot latch device 10 includes an upper flexible member 20 connected at its ends to a lower flexible member 22. Each flexible member 20 and 22 includes an inner face which together define the lace receiving region 18.

The upper flexible member 20 includes an outer face having a plurality of loop elements 24, and the lower flexible member includes a region 26 having a plurality of hook elements 28 as best illustrated in FIG. 5. The loop and hook elements 24 and 28 are designed to mate with each other. As will be apparent to those skilled in the art, the hook elements may be included on the outer face of the upper flexible member 20, and the loop elements may be included in the region 26 of the lower flexible member 22.

Referring to FIGS. 4, 5 and 6, the knot latch device 10 is placed on the shoe with the shoelace 14 passing through the lace receiving region 18 of the knot latch device 10. The shoelace 14 is then bowed about the upper flexible member 20 to form a bow 30 as best illustrated in FIG. 5.

The upper and lower flexible members 20 and 22 are then moved toward each other, thereby reducing the separation between their inner faces. The ends of the knot latch device 10 are then moved in the directions of the arrows A and B illustrated in FIG. 4. The ends of the knot latch device are moved closer and closer together, securing the device about the bow 30, until the position illustrated in FIG. 6 is achieved. In that position, the hook elements 28 are mated with the loop elements 24.

Referring now to FIG. 2, the knot latch device 10 is shown in perspective view fastened about the bow 30 on the shoe 12. FIG. 3 illustrates an alternate embodiment of the knot latch device 10 illustrated in FIG. 2, wherein clown structure 32 is included to mask at least a portion of the outer face of the lower flexible member 22.

In an alternate embodiment (not illustrated), the outer face of the upper flexible member 20 includes both loop elements and hoop elements. In operation, when the knot latch device is foled about the bowed shoelace, the loop elements on the outer face of the member 20 mate with oppositely disposed hook elements also included on the outer face of the member 20, firmly securing the bowed lace between adjacent oppositely disposed portions of the outer face 20. As will be apparent to those skilled in the art, the region 26 may also include both hook and loop elements.

In another alternate embodiment (not illustrated), the lower flexible member 22 is shorter in length than the upper flexible member 20, and is connected to the inner face of the upper member 20 at suitable locations disposed between the ends of the member 20. So connected, the lace receiving region 18 is defined by the inner face of the shorter lower member and the portion of the inner face of the upper flexible member 20 disposed between the suitable connection locations. In this embodiment, the loop elements 24 are included on the outer face of the upper flexible member 20 proximate one end of the knot latch device 10, and the hook elements 28 are included on the inner face of the upper flexible member 20 proximate the other end of the knot latch device 10. In yet another embodiment, the lower flexible member consists of a cylindrical band of flexible material having an inner face which defines the lace receiving region 18, and an outer face which is connected to the inner face of the upper flexible member 20.

As will be apparent to those skilled in the art, the knot latch device may be used not just on footwear, but anywhere in which a bowed lace or string is to be secured. As will also be apparent to those skilled in the art, any suitable releasable locking structure may be used in place of the hook and loop elements 28 and 24.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A knot latch device adapted to secure a lace member, comprising:

a flexible upper member having first and second ends and first and second faces;

a flexible lower member having first and second ends and first and second faces, said first and second ends of said lower member being connected to said first and second ends of said upper member, respectively, said second faces of said upper and lower members being adjacently disposed and defining structure adapted to receive said lace member;

first releasable locking structure included on at least a portion of said first face of said upper member; and second releasable locking structure included on at least a portion of the first face of said lower member and adapted to mate with said first releasable locking structure.

2. The knot latch device according to claim 1 wherein one of said first and second releasable locking structures includes a plurality of loop elements, and the other of said first and second releasable locking structures includes a plurality of hook elements.

3. The knot latch device of claim 1 further comprising structure included on at least a portion of the first face of said lower member to mask at least a portion of said first face when said first and second releasable locking structures are mated.

* * * * *